United States Patent [19]

Adams et al.

[11] 4,286,835

[45] Sep. 1, 1981

[54] MODULAR TELEPHONE CONNECTOR

[75] Inventors: William J. Adams, Franklin; Jeffrey W. Moorse, Antioch, both of Tenn.; Steve W. Haskins, Corinth, Miss.

[73] Assignee: Northern Telecom Inc., Ottawa, Canada

[21] Appl. No.: 171,178

[22] Filed: Jul. 22, 1980

[51] Int. Cl.[3] ..... H01R 13/62

[52] U.S. Cl. ..... 339/17 F; 339/17 C; 339/99 R; 339/122 R

[58] Field of Search ..... 339/17 LC, 17 F, 97 R, 339/17 C, 97 P, 98, 99, 122, 176 M; 174/52 R; 361/395, 399

[56] References Cited

U.S. PATENT DOCUMENTS

| | | | |
|---|---|---|---|
| 3,200,364 | 8/1965 | Forney, Jr. | 339/99 R |
| 3,873,173 | 3/1975 | Anhalt | 339/99 X |
| 4,202,593 | 5/1980 | Abernethy | 339/176 M X |
| 4,218,724 | 8/1980 | Kaufman | 361/399 X |

*Primary Examiner*—John McQuade
*Assistant Examiner*—John S. Brown
*Attorney, Agent, or Firm*—Schwartz, Jeffery, Schwaab, Mack, Blumenthal & Koch

[57] ABSTRACT

A modular telephone connector for use in providing connection of a telephone to both telephone lines and a separate power source, has a bottom member for fastening to a wall or other member at a required telephone position and a top assembly which attaches to the bottom member with a flat cable gripped between. On attachment of the top assembly to the bottom member, insulation piercing terminals pierce the cable and make contact with conductors in the cable. The top assembly includes a circuit board having conductor patterns to which the insulation piercing terminals are connected, and also to which are connected terminals from a modular jack, or jacks, mounted in the top assembly. A cover clips over top assembly and bottom member.

6 Claims, 4 Drawing Figures

MODULAR TELEPHONE CONNECTOR

This invention relates to a modular telephone connector, and is particularly concerned with a connector by which a domestic or small business telephone user can connect business telecommunications apparatus and systems which require a power supply. With the connector, such a user can connect his apparatus himself, or it can readily be done by any electrical installer.

Many forms of telecommunications apparatus and systems, such as a "hands free" telephone unit, require a power source, usually 24 V. D.C. separate from the telephone line.

Previously connection of such apparatus was made by the telephone company but with the present trend to the telephone company providing service to the premises and the user after providing his own apparatus, installation is often carried out by persons other than telephone company staff.

The present invention provides a modular connector which is connected via a flat cable to a suitable position where connection to the telephone line and a power source can be made, the connector connected to the flat cable by the clamping together of its parts, with one or more jacks for plugging in of telephones to the connector.

Broadly the connector comprises a bottom member, a top assembly for attachment to the bottom part, and a cover. Attachment of the top assembly to the bottom member clamps the flat cable therebetween and makes electrical contact with the conductors of the cable. The cover is then slipped on.

The invention will be readily understood by the following description of an embodiment, by way of example, in conjunction with the accompanying drawings, in which.

Figure 3:
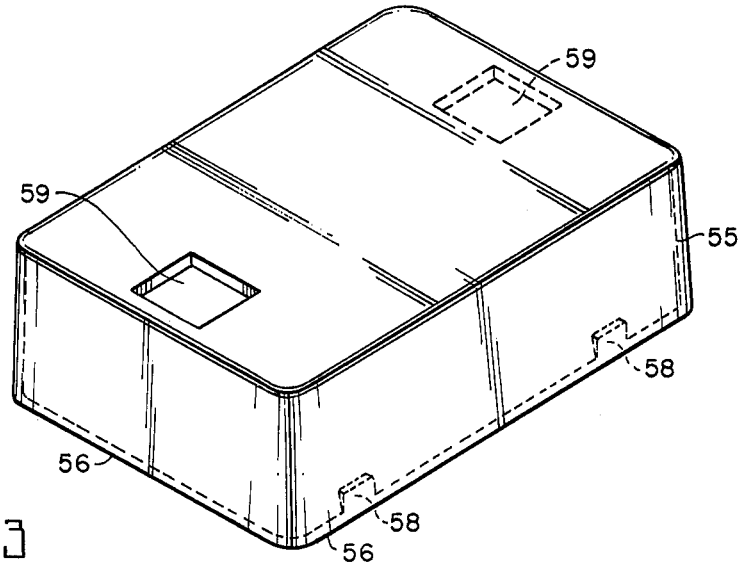
FIG. 3 is a perspective view of a cover.
Figure 1:
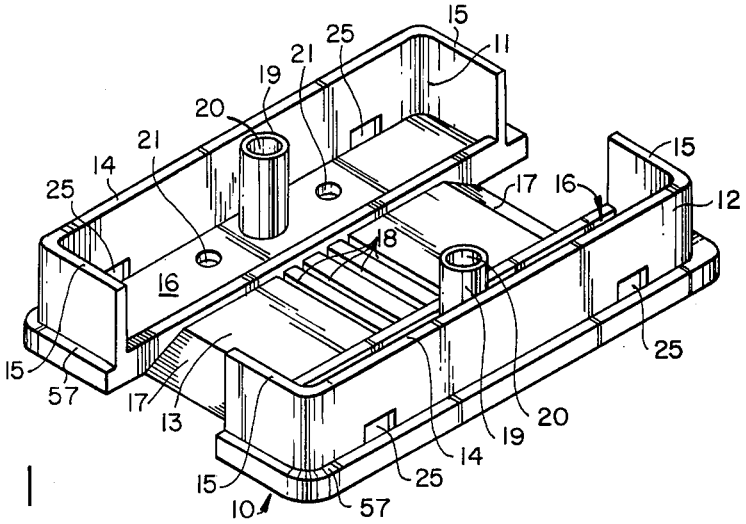
FIG. 1 is a perspective view of a bottom member.

The bottom member 10, as illustrated in FIG. 1 is of a generally trough shaped configuration, having two side portions 11 and 12, one on each side of a central portion 13. The side portions each have sides and ends, 14 and 15 respectively, which form partial enclosures, with base portions 16. The central portion 13 extends between the base portions 16, with a ramp 17 at each end, a flat top surface extending between the ramps, and a series of transverse grooves or slots 18 approximately midway between the ramps 17, and forms a channel for a flat cable.

On each base portion 16, midway along the length of each side portion is a hollow boss 19, each boss having a bore 20, which may be threaded. Holes 21 provide for attachment to a wall or other member.

In each side 14 at its junction with the base portion 16, are formed two apertures 25, toward each end of each side.

Figure 2:
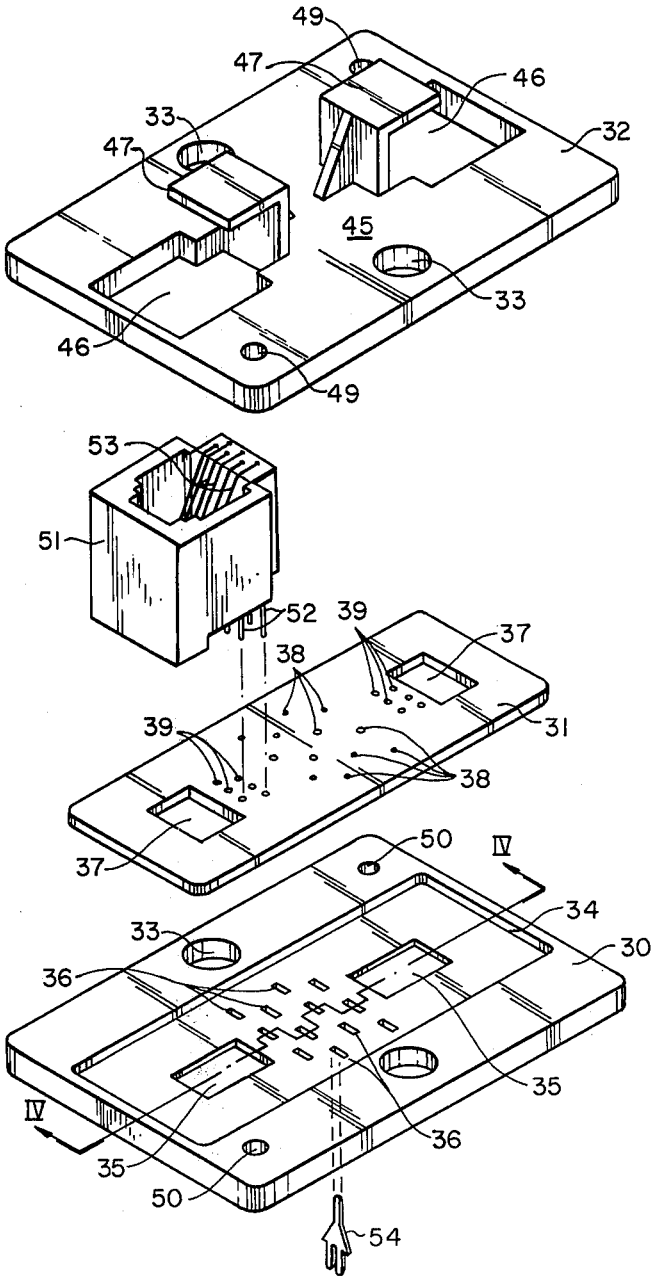
FIG. 2 is a perspective exploded view of a top assembly.

The top assembly, illustrated in FIG. 2, comprises a base 30, an insert 31 and a top member 32. The base is of a shape and dimensions to fit inside the sides and ends of the bottom member 10, as is also the top member, and base and top member have apertures 33 which fit over the bosses 19. The base is generally flat, and has a recess 34 within which fits the insert 31. Two rectangular spaced apertures 35 are formed through the base in the recess and between the apertures 35 are four rows of small elongate apertures 36. The apertures are in rows of three, the apertures of one row offset laterally relative to the next row. This forms six pairs of apertures, the pairs spaced apart along the length of the base.

The insert, in the embodiment illustrated, has rectangular apertures 37 which, when the insert is positioned in the recess 34, overlie the apertures 35. Four pairs of holes 38 extend through the insert, the holes aligned with the apertures 36, a hole for each aperture. Six small holes or perforations 39 extend through the insert between each aperture 37 and the holes 38. The insert is a printed circuit board and carries printed conductor patterns to which terminals positioned in the holes 38 and 39 can be connected, as described below.

The top member 32 has a main flat portion 45 with apertures 46 at each end overlying the apertures 35. Extending upward from the flat part 45 are two inverted L shaped members 47. The L shaped members extend up from the inner edges of the apertures 46, that is the edges remote from ends of the top, and outward towards the ends, over part of the apertures 46. Strengthening ribs 48 are provided. Two holes 49 in the top 32 accept screws, not shown, which screw into two similar holes 50 in the base 30. A modular jack 51 is positioned in each aperture 46 with terminals 52 which are positioned in the holes 39, and connect to the conductor patterns on the insert 31. The jack has spring wire terminals 53 which contact terminals in a telephone line cord. The jack 51 is typically of the general form of a jack as described in U.S. Pat. No. 3,850,497. Bifurcated insulation piercing terminals 54 are positioned in the apertures 36, tail portions of the terminals entering the holes 38 and being connected to the conductor patterns on the insert 31.

The modular jacks 51 sit in the apertures 46 under the top of the L-shaped members 47. The insulation slicing terminals 54, such as are described in Canadian Pat. No. 1,029,109, extend down from the apertures 36, and on assembly of the whole connector, extend into the grooves 18 of the bottom member.

There are six contacts in the jack and six conductors in the flat cable, and the terminals, extending through the apertures 36, form six pairs. Thus each conductor is contacted by two terminals. Base 30, insert 31 and 32 are fastened together by screws through holes 49 and 50.

The cover 55 fits over the sides 14 and ends 15 of the bottom member, being of hollow box-like form, and the edges 56 of the cover rest on a ridge 57 round the peripheries of the side portions 11 and 12 of the bottom member. Projections, as indicated at 58, on the inside of the cover at its edges, snap into the apertures 25 in the bottom member. In the example illustrated, a single aperture 59 is formed in the cover top, aligned with aperture 46, but a further aperture 59 can be provided for permitting insertion of two telephone plugs.

The invention is used as folows. At a convenient position, for example a basement in a house or other building, one end of a flat cable is connected to a 24 volt D.C. supply, as by through a transformer and rectifier. This takes two of the conductors. The flat cable is also connected to the telephone line, this taking four conductors, requiring a six-conductor flat cable. The flat cable is then run to wherever the telephone set or other telecommunications apparatus is required. The flat cable is then laid over the central portion 13 of the bottom member, which is attached to a wall or other member, the top assembly positioned on the bottom member, sliding over the bosses 19; the bottom member and top assembly positioned at the desired place; and screws inserted into the apertures 33, and screwed into a supporting structure. As the screws are tightened, the top assembly is forced into the bottom member and the terminals cut through the insulation of the conductors of the cable, making contact with the metal conductors. The jacks at apertures 46 are thus onnected to the power supply and telephone line. After the top assembly is tightly secured down, the cover 55 is pushed over the bottom member and clipped into place.

Figure 4:
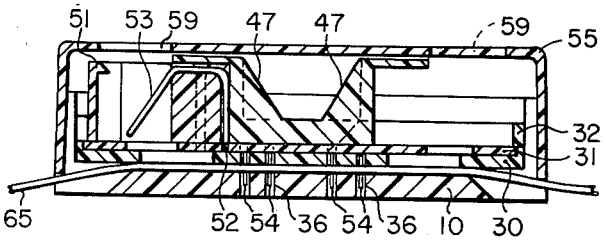
FIG. 4 is a cross-section through an assembled connector, as on the line IV—IV of FIG. 2.

This is illustrated in FIG. 4. The flat cable is at 65. In the example in FIG. 4 only one jack 51 is illustrated but a further jack can be provided. The terminals 54 are shown passing through the cable, and a conductor would be contacted by two terminals.

Preferably the flat cable is cut so that the end is within the connector so that conductor ends are not exposed. It is possible to provide single acting screws that can be screwed in but not removed, to avoid having bare conductors exposed by removal of the top assembly.

The connector will normally be supplied in three parts, the bottom member, the top assembly assembled with terminals and jacks, and the cover.

What is claimed is:

1. A modular telephone connector comprising a bottom member, a top assembly and a cover;

said top assembly comprising a base;

a recess in an upper surface of said base;

an insert positioned in said recess and carrying circuit patterns on at least one surface thereof;

a top member attached to the base;

at least one modular jack positioned in an aperture in said top member and retained therein, the jack including terminals passing into holes in said insert and connected to said circuit patterns;

and insulation piercing terminals positioned in apertures in said base and extending downward therefrom, the insulation piercing terminals including tail portions extending into holes in said insert and connected to said circuit patterns;

said bottom member including recesses into which said insulation piercing terminals enter, the arrangement being such that a flat cable is gripped between said bottom member and said base of said top assembly and said insulation piercing terminals pierce the cable and make electrical contact with conductors in said cable;

said cover including means for retaining said cover on said bottom member and top assembly.

2. A connector as claimed in claim 1, said bottom member of a trough shaped configuration having side portions and a central portion, said central portion defining a channel for said flat cable, said recesses in the bottom member formed by transverse slots extending across said center portion.

3. A connector as claimed in claim 2, said side portions including sides and ends extending up from a bottom surface and forming an enclosure, said top assembly fitting in said enclosure.

4. A connector as claimed in claim 3, including a hollow boss extending up from the bottom surface of each side portions, and apertures in said base and said top member of the top assembly aligned with said bosses.

5. A connector as claimed in claim 1, including an aperture at each end of the top member of the top assembly and an L-shaped member extending up from a top surface of the top member from an inner edge of each aperture and extending outward over each aperture, to retain a modular jack in an aperture, the jack positioned between the L-shaped member and said insert.

6. A connector as claimed in claim 3, the cover extending outside said sides and ends, apertures in said sides and projections on inner surfaces of said cover, said projections snapping into said apertures in said sides.

* * * * *